United States Patent [19]

Orndorff et al.

[11] Patent Number: 4,749,061

[45] Date of Patent: Jun. 7, 1988

[54] ELEVATOR CAB

[75] Inventors: Karl B. Orndorff, Bonneauville Boro; Paul L. Baldwin, Franklin Twp., Adams Co., both of Pa.

[73] Assignee: Westinghouse Electric Corp., Pittsburgh, Pa.

[21] Appl. No.: 20,042

[22] Filed: Feb. 27, 1987

[51] Int. Cl.[4] ..... B66B 9/00

[52] U.S. Cl. ..... 187/1 R; 362/150

[58] Field of Search ..... 187/1 R; 362/148, 149, 362/150, 147; 52/28

[56] References Cited

U.S. PATENT DOCUMENTS

| | | | |
|---|---|---|---|
| 2,926,237 | 2/1960 | Sorenson | 362/150 |
| 3,352,071 | 11/1967 | Satter | 362/150 |
| 4,126,210 | 11/1978 | Martin | 187/1 R |
| 4,164,011 | 8/1979 | Sherwood | 362/148 |
| 4,361,992 | 12/1982 | Rapp | 362/148 |
| 4,425,603 | 1/1984 | Courson | 362/222 |

FOREIGN PATENT DOCUMENTS

| | | | |
|---|---|---|---|
| 1034562 | 5/1957 | Fed. Rep. of Germany | 362/148 |

*Primary Examiner*—Joseph J. Rolla
*Assistant Examiner*—Kenneth Noland
*Attorney, Agent, or Firm*—D. R. Lackey

[57] ABSTRACT

An elevator cab, and methods of constructing same, in which sections of a drop ceiling with integral lighting are factory assembled. The sections of the drop ceiling are brought to a job site and assembled in the elevator cab after the cab enclosure, which includes side walls and a canopy, has been assembled on a platform in a hatchway. First and second side sections or assemblies are suspended from the canopy via quickly coupled sections of hanger strap assemblies, and an intermediate or center section, which may include more than one assembly, is then positioned and supported by the first and second side assemblies. The assemblies which make up the center section of the drop ceiling are leveled via thumb screws accessible through an emergency opening in the canopy, and the assemblies of the center section are fixed to the side assemblies, also via thumb screws accessible through the canopy opening. One assembly of the drop ceiling is directly electrified from an external source, and plugs and receptacles on the assemblies, accessible via the canopy opening, are interconnected to complete the electrification of the drop ceiling. The drop ceiling may include incandescent down lights mounted in elongated metallic members which also function as electrical junction boxes and stiffening ribs, and/or fluorescent perimeter lighting, as desired.

13 Claims, 5 Drawing Sheets

FIG. 7
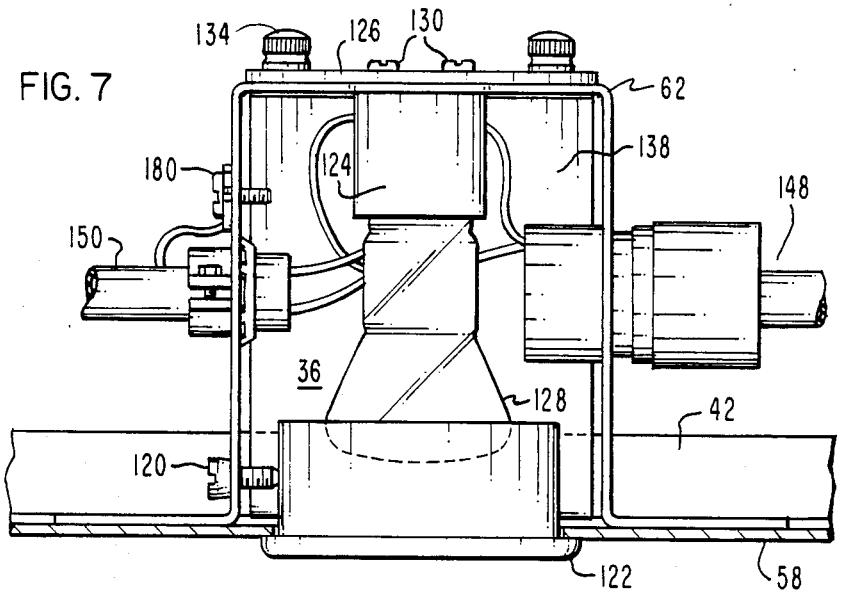
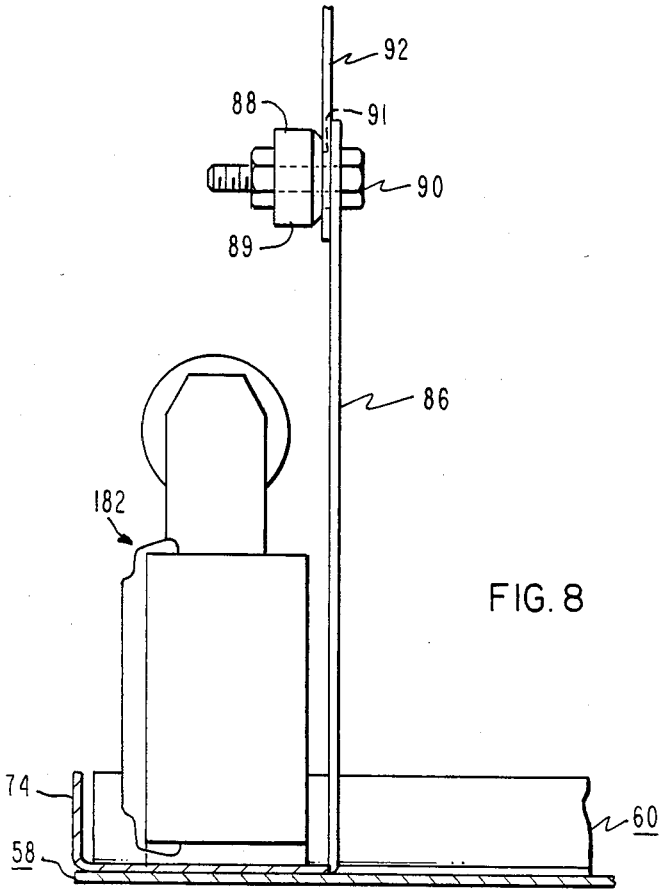
FIG. 8

ELEVATOR CAB

BACKGROUND OF THE INVENTION

1. Field of the Invention

The invention relates in general to elevator cabs, and more specifically to a new and improved drop ceiling construction for elevator cabs.

2. Description of the Prior Art

An elevator cab usually includes a platform, side walls on the platform, a ceiling called a canopy supported by the side walls, a decorative drop ceiling suspended from the canopy, and a light source disposed between the canopy and drop ceiling. In some constructions, fluorescent light fixtures are fastened to the canopy, and thus the drop ceiling may consist of a frame constructed of right angle members and light weight "egg crate" type panels supported by the frame. In more decorative constructions, a plurality of incandescent lamp fixtures called "down lights" are fixed to the drop ceiling, on the upper side thereof, with cab illumination being provided by openings through the drop ceiling below each lamp fixture. In this latter construction the drop ceiling is relatively heavy, and the assembly of the drop ceiling to the canopy is usually done in the factory. The canopy and drop ceiling are transported as a unit to a job site, maneuvered into an elevator hatchway, and suspended above the cab platform while the cab walls are assembled on the platform. When the side walls are completely assembled, the canopy and drop ceiling are lowered onto the side walls and fixed thereto.

It would be desirable to provide a new and improved drop ceiling for elevator cabs, and methods of assembling same, which improves the drop ceiling and its assembly methods while reducing assembly time and cost.

SUMMARY OF THE INVENTION

Briefly, the present invention is a new and improved elevator cab, and method of constructing same, which cab includes a canopy and a drop ceiling with integral lighting. The drop ceiling is constructed in sections, including first and second side sections each comprising a single assembly, and a center section which usually includes two or three assemblies, permitting the drop ceiling to be brought into the elevator cab through the normal entrance, after the cab walls and canopy have been assembled on a platform in an elevator hatchway.

The first and second side assemblies are each independently suspended from the canopy via a plurality of hanger strap assemblies. Each hanger strap assembly includes a depending portion which is simply dropped into a pair of spaced slots in the canopy, an upstanding portion fixed to a side assembly, and coupling means which permits all hanger strap assemblies to be simultaneously coupled without additional fastener hardware.

The coupling means includes a spacer block having head and shank portions, which block is fixed to the upstanding portion of a hanger strap assembly. The coupling means further includes a spacer block receiving elongated slot in the depending portion, which slot includes an enlarged portion for receiving the head of a spacer block and a narrow spacer head capturing portion dimensioned to receive the shank portion. Thus, a side assembly of the drop ceiling is simply lifted to orient the spacer blocks with the enlarged portions of the elongated slots. The side assembly is then moved horizontally to cause the head portions of the spacer blocks to enter the enlarged portions, and it is then lowered to cause the shank portions of the spacer blocks to enter the narrowing spacer head capturing portions of the elongated slots.

After the two side assemblies of the drop ceiling have been suspended from the canopy, the center assemblies of the drop ceiling are each successively disposed at an angle which allows them to be lifted to enter the space between, and then to be lifted above, the two side assemblies. Each center assembly is then horizontally oriented and lowered such that portions of each center assembly overlap both side assemblies. Thus, the sole support for each center assembly is provided by the two side assemblies.

Each center assembly includes adjustment means accessible through an emergency opening in the canopy, for planar alignment of a flat lower surface of each center assembly with flat lower surfaces of the two side assemblies. Fastener means, also accessible through the opening in the canopy, is then actuated to fix each center assembly to the two side assemblies of the drop ceiling.

The various assemblies of the drop ceiling may be provided with fluorescent perimeter lighting, and/or with incandescent down lights, as desired. In the down light construction, an elongated wiring trough is provided on each assembly which also functions as a lamp fixture for one or more incandescent lamps, and as a stiffening rib for the drop ceiling. One of the center assemblies is electrified from an external power source, while plugs and receptacles, associated with the assemblies, which are accessible through the opening in the canopy, are connected to route the electrical power to the remaining assemblies.

BRIEF DESCRIPTION OF THE DRAWINGS

The invention may be better understood, and further advantages and uses of the invention more readily apparent, when considered in view of the following detailed description of exemplary embodiments, taken with the accompanying drawings in which:

FIG. 7 is a cross sectional view of the drop ceiling shown in FIG. 2, taken between and in the direction of arrows VII—VII in FIG. 2; and FIG. 8 is a cross sectional view of the drop ceiling shown in FIG. 2, taken between and in the direction of arrows VIII—VIII in FIG. 2.

DESCRIPTION OF PREFERRED EMBODIMENTS

Figure 1:
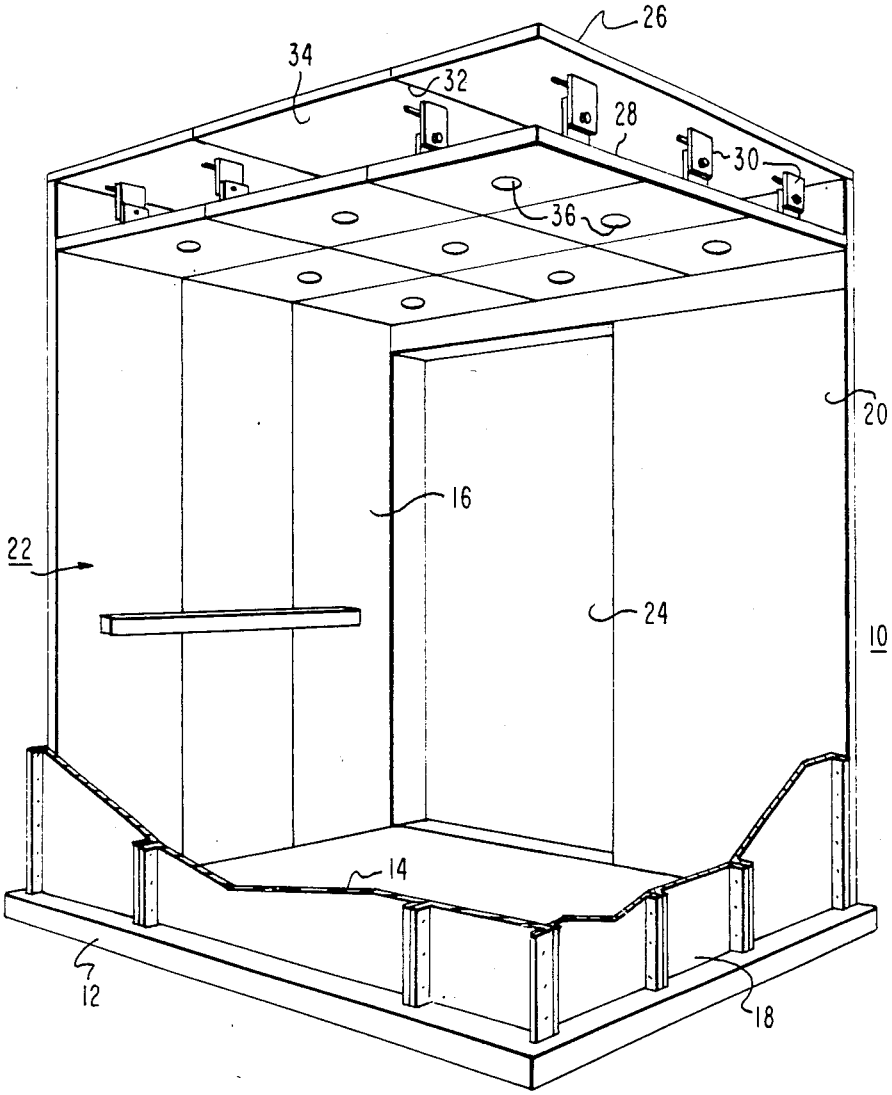
FIG. 1 is a perspective view of an elevator cab, shown partially cut away, illustrating a drop ceiling constructed according to the teachings of the invention.

Referring now to the drawings, and to FIG. 1 in particular, there is shown an elevator cab 10 which is constructed according to the teachings of the invention. Elevator cab 10 includes a platform 12 which is supported in a building hatchway by a traction sling or a hydraulic cylinder, as desired, as is well known in the elevator art. Elevator cab 10 further includes four upstanding side wall portions, including a rear wall 14, first and second side walls 16 and 18, and a front wall 20, which are assembled on platform 12 to define an enclosure 22 having an entrance 24. A canopy 26 is fixed to the upper edges of enclosure 22, and a drop ceiling 28 is suspended from canopy 26 via a plurality of hanger strap assemblies 30. As illustrated, canopy 26 includes an opening 32 having a cover 34 openable from the top of the canopy, to provide an emergency exit. Opening 32 is also used to aid the assembly of the drop ceiling 28, as will be hereinafter explained in detail. While the drop ceiling 28 is illustrated in FIG. 1 with a plurality of incandescent down lights 36, the disclosed drop ceiling construction enables fluorescent perimeter lighting to supplement or replace the down lights, as desired.

Figure 2:
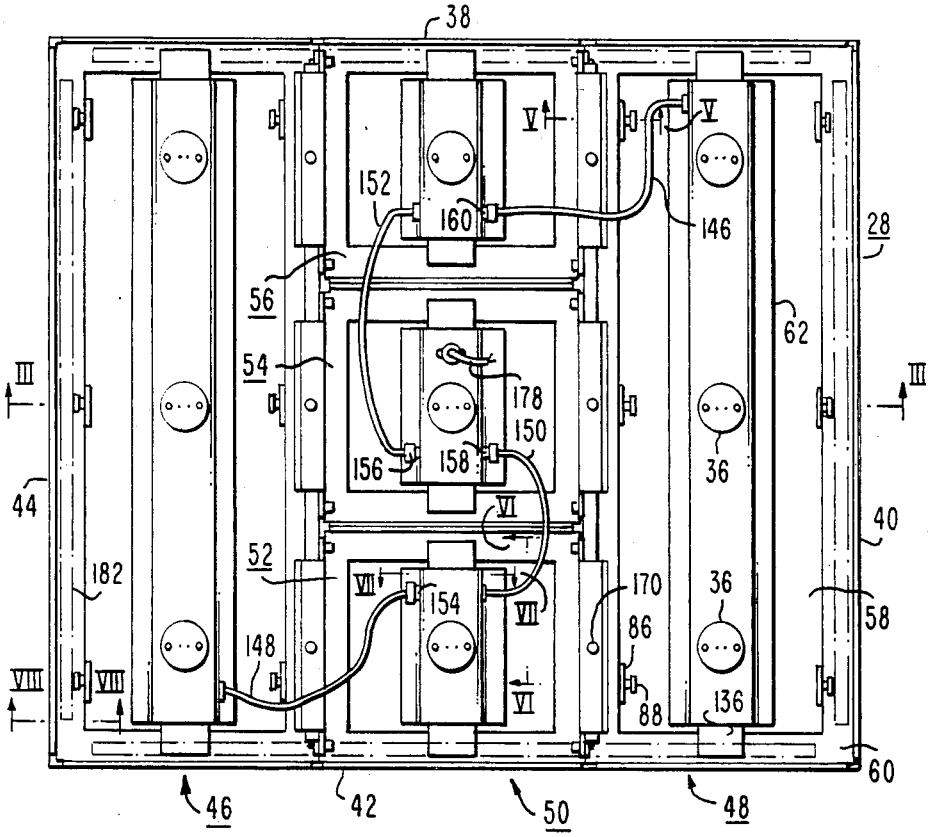
FIG. 2 is a plan view of the drop ceiling shown in FIG. 1.
Figure 3:
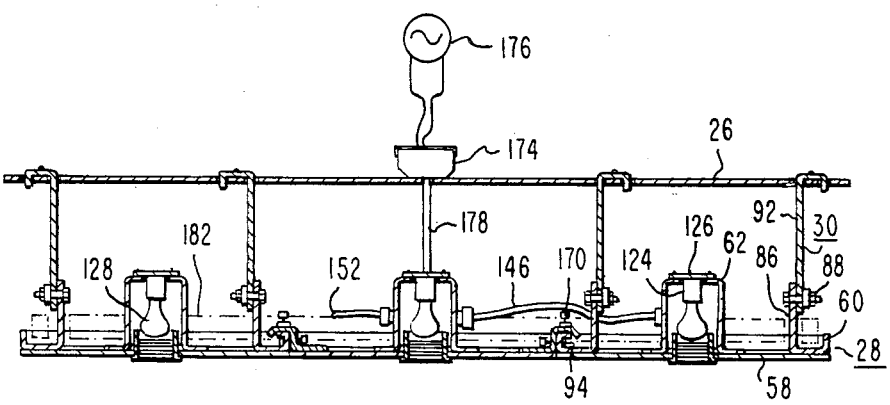
FIG. 3 is a cross sectional view of the drop ceiling shown in FIG. 2, taken between and in the direction of arrows III—III.

FIG. 2 is a plan view of the upper side of the drop ceiling 28, and FIG. 3 is a cross-sectional view of drop ceiling 28 taken between and in the direction of arrows III—III in FIG. 2. Drop ceiling 28 has a rectangular configuration, having sides 38, 40, 42 and 44, with side 38 being the rear of cab 10. Drop ceiling 28 is constructed in sections to permit its assembly inside enclosure 22 after the canopy 26 has been fixed to the top of the enclosure 22. The sections include first and second side sections 46 and 48, respectively, and a center section 50, all of which proceed from the front side 42 to the rear side 38 of the drop ceiling 28. The first and second side sections 40 and 42 are similar in construction, each comprising a single assembly. Since the side sections are single assemblies, the section reference numerals 46 and 48 will also be used to refer to the associated assemblies. The center section 50 includes a plurality of assemblies arranged end-to-end from the front side 42 to the rear side 38 of the drop ceiling. Three center assemblies 52, 54 and 56 are illustrated for purposes of example, with the number depending upon the type of lighting, i.e., fluorescent or incandescent, and the number of down lights when incandescent lighting is used. When three down lights 36 used in each section from the front 42 to the rear 38, as illustrated, then three assemblies are used. When two down lights are used, or when fluorescent perimeter lighting is used, two assemblies would be used in the center section.

Each of the side assemblies 46 and 48 and center assemblies 52, 54, and 56 have similar constructions, even though the center assemblies are shorter in the direction from the front side 42 to the rear side 38 of the drop ceiling, and thus only side assembly 48 will be completely described in detail. The same reference numerals will be used to refer to like elements of the various side and center assemblies of the drop ceiling 28. As will become apparent, the essential differences between the similar side assemblies 46 and 48 and the shorter center assemblies 52, 54 and 56 are in the way they are supported, and in the number of down lights 36 supported by the assemblies. The differences will be noted when appropriate in the following description.

Figure 4:
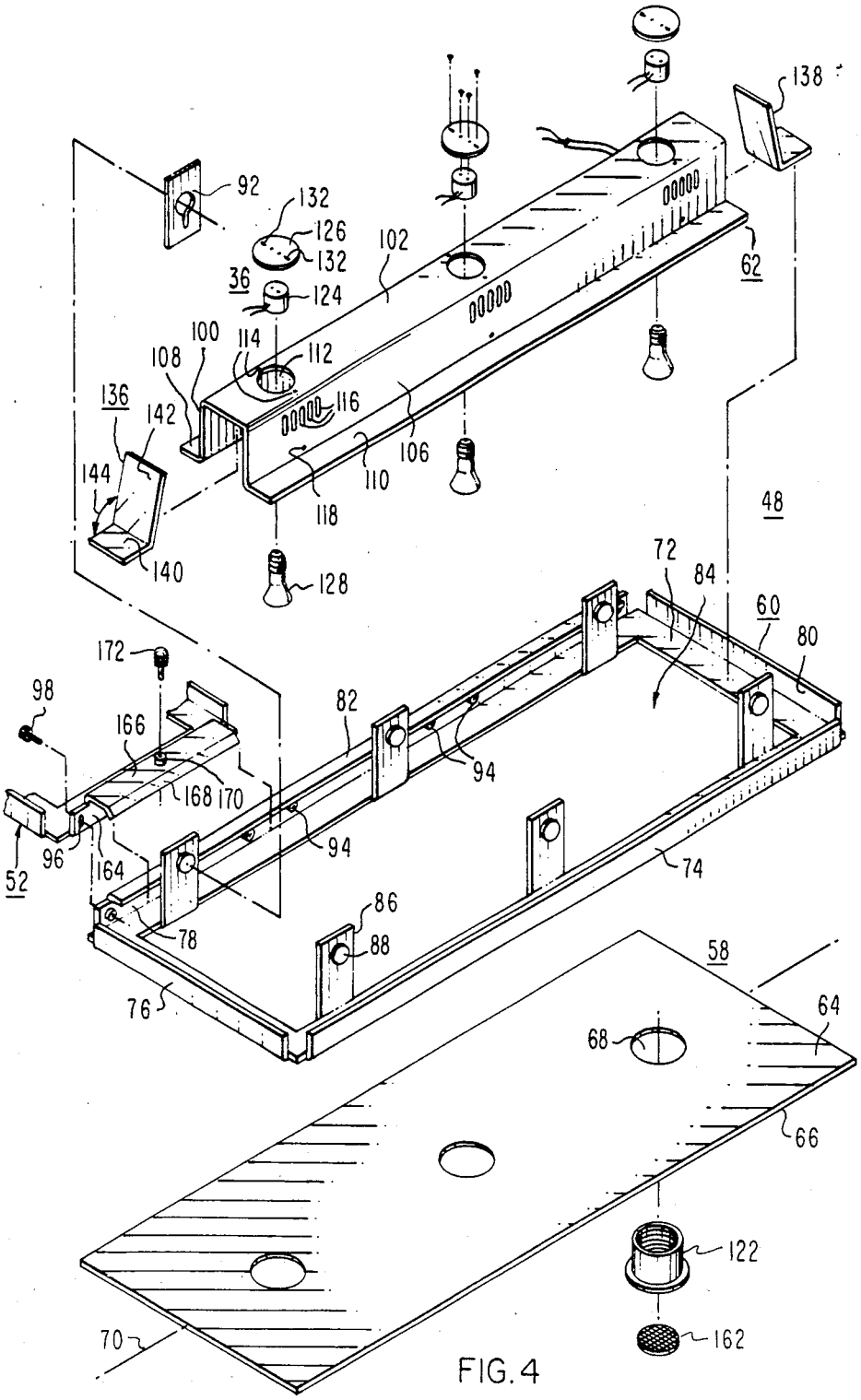
FIG. 4 is an exploded perspective view of one of the side assemblies shown in FIGS. 1-3.

FIG. 4 is an exploded perspective view of side assembly 48. In general, side assembly 48, as well as each of the remaining assemblies, includes a lower decorative face plate 58, an intermediate pan type metallic frame 60, and an elongated, multi-function metallic member 62.

The decorative face plate 58 has upper and lower major planar surfaces 64 and 66, respectively, with the lower surface 66 being finished according to cab decor. In a down light embodiment, face plate 58 includes a plurality of openings dictated by the number of down lights 36 which are to be supported by the assembly. In the example set forth in the drawings, each side assembly has three down lights 38, and thus face plate 58 has three openings 68 whose centers are spaced along a central axis 70 which extends from the front to the rear of the assembly 48.

The pan type frame 60 is formed from a flat rectangular sheet 72 of metal, such as 0.060 inch thick steel, with the edges of sheet 72 being bent to in a common direction to provide upstanding perimetrical flanges 74, 76, 78 and 80. Flange 78 which adjoins the center assemblies 52, 54 and 56 is additionally bent inwardly near its upper edge to provide a horizontally oriented portion 82 which is parallel with the flat sheet 72.

A center portion of the flat sheet 72 is cut out to define a relatively large rectangular opening 84. The pattern for opening 84 in the side assemblies 46 and 48 defines a plurality of spaced tabs on the sides of the opening 84 which are adjacent to flanges 74 and 78. The resulting spaced tabs are bent perpendicularly upward to provide upstanding lower portions 86 of the hanger strap assemblies 30. In a preferred embodiment of the invention, three upstanding lower portions 86 are provided on two oppositely facing sides of opening 84. The similar opening 84 in the center assemblies 52, 54 and 56 does not include the tabs, as the center assemblies are not directly suspended from canopy 26.

Figure 5:
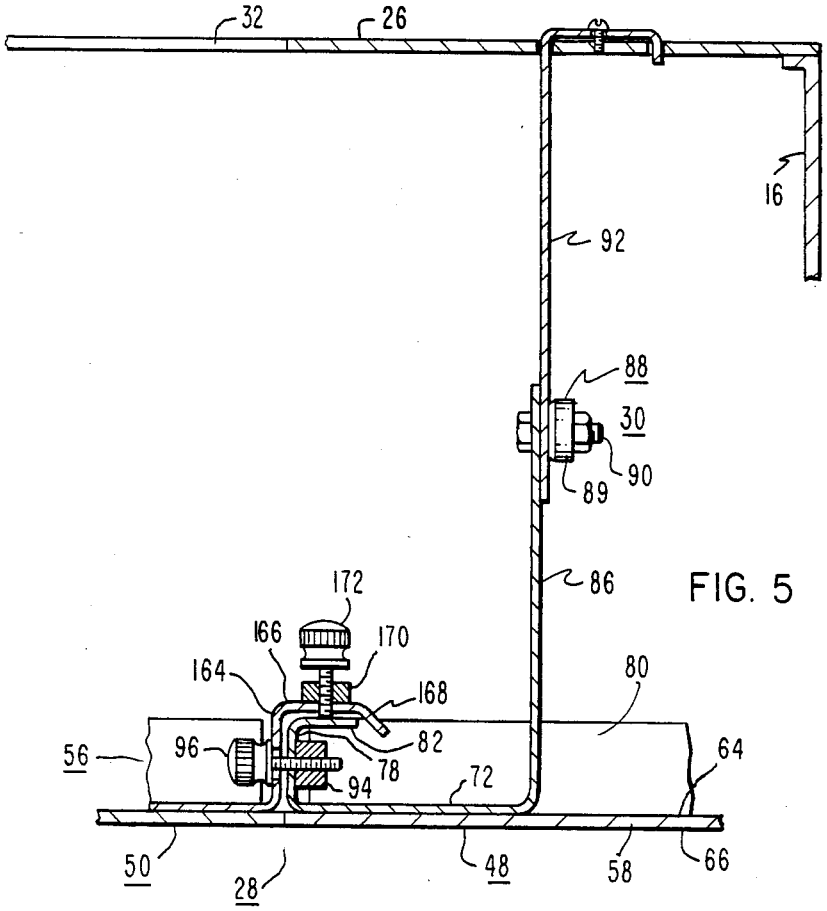
FIG. 5 is a cross sectional view of the drop ceiling shown in FIG. 2, taken between and in the direction of arrows V—V in FIG. 2.

A spacer block 88 having a head portion 89 and a shank portion 91 is attached to each upstanding lower portion 86, as best shown in FIGS. 5 and 8, which are cross sectional views respectively taken between and in the direction of arrows V—V and VIII—VIII in FIG. 2. For example, as shown in FIG. 5, spacer block 88 may be fastened to upstanding portion 86 with a nut and bolt assembly 90. As will hereinafter be described, spacer blocks 88 form one element of coupling means for coupling the upstanding lower portions 86 of the hanger strap assemblies 30 with depending portions 92 of the hanger strap assemblies 30, with depending portions 92 being fixed to the canopy 26.

The pan type frame 60 of the side assemblies 46 and 48 is completed by providing a plurality of spaced openings in the upstanding flange 78 which faces the center assemblies 52, 54 and 56, and a nut 94 is aligned with each such opening and fixed to the inner side of flange 78. The center assemblies 52, 54 and 56 include openings 96 in the upstanding flanges which face each side assemblies 46 and 48, for receiving thumb screws 98, as will be hereinafter explained.

The elongated multi-function metallic member 62 has a generally hat-shaped cross sectional configuration, including a U-shaped portion 100 having a bight 102 and spaced depending leg portions 104 and 106. The lower ends of leg portions 104 and 106 are bent perpendicularly outward to provide mounting flanges 108 and 110. In down light embodiments, for each down light to be associated with the assembly, a relatively large round opening 112 is provided in bight 102, tapped openings 114 are provided in bight 102 on opposite sides of opening 112, a plurality of openings 116 are provided in each leg portion 104 and 106 for providing ventilation for the down light, and an opening 118 is provided in at least one of the legs 104 or 106 for receiving a screw 120, shown in FIG. 7. Screw 120 is used to secure a bezel 122 in opening 68 of the face plate 58 during the assembly of a down light 36.

Each down light 36 includes a socket 124, a round mounting plate 126, and an incandescent bulb or lamp 128. Socket 124 is secured to one side of mounting plate 126, such as with screws 130 shown in FIG. 7, and mounting plate 126 has elongated slots 132 which receive thumb screws 134 which cooperate with tapped openings 114 in bight 102.

End caps 136 and 138 are provided to close the open ends of the elongated metallic member 62. Each end cap 136 and 138, such as end cap 136, includes first and second leg portions 140 and 142, respectively, joined by an obtuse angle 144 which enables leg portion 140 to be fixed to the pan frame 60 while leg portion 142 extends into an open end of member 62. Leg portion 142 closes an open end of member 62 while extending far enough into the opening at bight 102 to provide a finger-sized recess suitable for lifting and handling the associated assembly.

Side assembly 48 is assembled by fixing the lower surface of pan frame 60 to the upper surface 64 of face plate 58, such as by gluing. A major portion of the upper surface 64 of face plate 58 is then accessible via opening 84 in pan frame 60, and the mounting flanges of elongated member 62 are fixed to surface 64, such a by gluing. Leg portions 140 of end caps 136 and 138 are fixed to pan frame 60, such as by gluing, while leg portions 142 extend into opposite ends of elongated member 62 to create a large closed electrical junction box.

Electrical cords with plugs are attached to certain of the drop ceiling assemblies, such as electrical cords and plugs 146, 148, 150 and 152 associated with drop ceiling assemblies 48, 50, 52 and 56, respectively. Electrical receptacles for receiving electrical plugs are fixed to certain of the drop ceiling assemblies, such as receptacle 154 on assembly 52, receptacles 156 and 158 on assembly 54, and receptacle 160 on assembly 56.

Sockets 124 of each down light 36 are fastened to mounting plates 126 via screws 130, sockets 124 are electrically connected to appropriate plugs and receptacles via wiring temporarily brought out through an opening 112 in bight 102, and the sockets and their associated mounting plates are then mounted on bight 102 with thumb screws 134. Lamps 36 are inserted into sockets 124 through openings 68 in the face plate 58, bezels 122 are mounted below the lamps 128 in openings 68, screws 120 are advanced to hold the bezels in the assembled positions, and screens 162, shown in FIG. 4, are inserted into bezels 122 to hold pieces of a lamp, should it become broken during service.

The assemblies of the center section 50, as hereinbefore stated, are similar in construction to the side assemblies 46 and 48. One difference is the way in which the center assemblies are supported. Instead of being suspended from canopy 26 via hanger strap assemblies 30, they are each supported by the two side assemblies 46 and 48. This is accomplished as best shown in FIG. 4 relative to center assembly 52, by forming the upstanding flanges which will adjoin the side assemblies 46 and 48 with portions which will overlap the horizontally oriented portions 82 of the side assemblies 46 and 48. More specifically, center assembly 52 includes an upstanding flange 164 which will be adjacent to upstanding flange 78 of side assembly 48 when the side and center assemblies of the drop ceiling are assembled. Flange 164 has two bends formed therein, a right angle bend which forms an outwardly extending, horizontally oriented portion 166, and a less than right angle bend which forms a portion 168 which extends downwardly at a predetermined angle from the horizontal. The dimension between the two bends is selected such that portion 166 "seats" itself on portion 82 of the adjacent side assembly 46 or 48.

As best shown in FIG. 5, the horizontal portions 166 have one or more openings therein, with a nut 170 fixed to portion 166 in alignment with an opening. A thumb screw 172 is engaged with each nut 170. Thumb screws 172 and nuts 170 function as leveling means accessible through canopy opening 32, for achieving planar alignment of the lower surfaces 66 of the various face plates 58 of the drop ceiling assemblies. As hereinbefore stated, the upstanding flanges 164 include vertically oriented slots 96, which, along with nuts 94 and thumb screws 98, form means for fixing the center assemblies 52, 54 and 56 to the side assemblies 46 and 48, after planar alignment of the face plates has been achieved.

Figure 6:
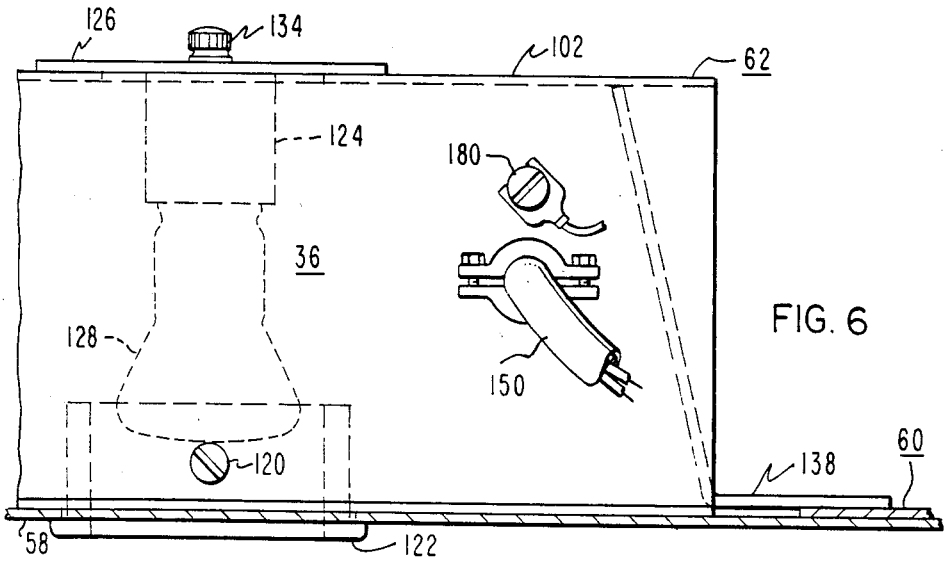
FIG. 6 is a cross sectional view of the drop ceiling shown in FIG. 2, taken between and in the direction of arrows VI—VI in FIG. 2.

As shown in FIGS. 2 and 3, one of the center assemblies, such as center assembly 54, is directly electrified via a wire 178, a junction box 174 disposed on canopy 26, and an external source 176 of electrical power. The remaining assemblies derive electrical power from assembly 54 via cord and plugs 146, 148, 150 and 152 and the associated receptacles 154, 156, 158 and 160, as shown in FIGS. 2, 6, and 7. The various plugs are inserted into the electrical receptacles after assembly of the drop ceiling 28, with access to the plugs and receptacles being gained through canopy opening 32. As best shown in Figures 6 and 7, grounding screws 180 may be provided adjacent to the plugs and receptacles.

The disclosed pan frame construction wherein relatively wide, upwardly facing flat portions are formed about each pan frame 60, enables fluorescent lighting fixtures 182, shown in phantom in FIG. 2 and in solid in the cross sectional view of FIG. 8, to be supported about the periphery of drop ceiling 28. Fluorescent lighting fixtures 182 provide perimeter lighting by spacing the edges of the drop ceiling 28 from the side walls of the elevator cab 10. The perimeter lighting may supplement the down lighting, or fluorescent perimeter lighting may be used in place of the down lights 36, as desired.

In summary, there has been disclosed a new and improved elevator cab 10, and methods of constructing same, in which a drop ceiling 28 with integral lighting is installed in an elevator cab 10 after the cab has been assembled in a hatchway. The drop ceiling 28 is constructed in factory assembled sections which include first and second side sections or assemblies 46 and 48 and a center section which includes at least one, and usually two or three, separate assemblies, such as assemblies 52, 54 and 56. An assembler located on top of the canopy drops depending portions 92 of hanger strap assemblies 30 through slots in the canopy 26, and an assembler in the cab enclosure 22 hangs the sections of the drop ceiling 28. The first and second side assemblies 46 and 48 are suspended from canopy 26 by the quickly coupled portions of the hanger strap assemblies 30. Each center assembly is then oriented at an angle which enables it to be lifted upward between the side assemblies 46 and 48, horizontally oriented above the side assemblies, and then lowered such that portions 166 of the center assembly overlap portions 82 of the side assemblies. The assembler on the canopy adjusts leveling screws 172 according to instructions from the assembler in enclosure 22, to achieve planar alignment of the lower surfaces 66 of the face plates 58. The assembler on the canopy then inserts thumb screws 98 into slots 96 to threadably engage nuts 94, to firmly secure the center assemblies to the side assemblies of the drop ceiling. The assembler on the canopy also connects the electrical plugs with predetermined receptacles, to electrically interconnect the assemblies. Finally, the electrical connection 178 from junction box 174 to center assembly 54 is made to electrify the drop ceiling.

We claim as our invention:

1. In combination, a platform, an elevator cab on said platform, said elevator cab including sidewalls and a canopy having an opening therein, said canopy being supported by said side walls, a drop ceiling disposed below and spaced from said canopy, said drop ceiling including first and second side assemblies and at least one center assembly which extends between said first and second side assemblies, each of said first and second side assemblies and said at least one center assembly including a planar surface which faces said platform, means suspending said first and second side assemblies from said canopy, said at least one center assembly including first and second portions which overlap said first and second side assemblies such that said first and second side assemblies provide the sole support for said at least one center assembly, and adjustment means on the overlapping portions of said at least one center assembly, accessible through the opening in said canopy, said adjustment means adjustably spacing the first and second overlapping portions of said at least one center assembly from the first and second side assemblies for planar alignment of the planar surface of said at least one center assembly with the planar surfaces of said first and second side assemblies.

2. The combination of claim 1 wherein the means suspending each of the first and second side assemblies from the canopy include a plurality of hanger strap assemblies each having a depending portion fixed to the canopy, an upstanding portion fixed to a side assembly, and coupling means for coupling the depending and upstanding portions, said coupling means including a spacer member fixed to one of said hanger strap portions and a spacer member cooperative elongated opening in the other of said hanger strap portions, enabling all of the hanger strap assemblies associated with one of the side assemblies to be simultaneously coupled.

3. An elevator cab, comprising:

a platform, sidewalls on said platform, a canopy having an opening therein, said canopy being supported by said sidewalls, a drop ceiling disposed below and spaced from said canopy, said drop ceiling including first and second side assemblies and at least one center assembly which extends between said first and second side assemblies, means suspending said first and second side assemblies from said canopy, said at least one center assembly including first and second portions which overlap said first and second side assemblies such that said first and second side assemblies provide the sole support for said at least one center assembly, adjustment means on the overlapping portions of said at least one center assembly, accessible through the opening in said canopy, said adjustment means adjustably spacing the first and second overlapping portions of said at least one center assembly from the first and second side assemblies for planar alignment of a portion of said at least one center assembly with portions of said first and second side assemblies, and fastener means accessible through the opening in the canopy for fixing the at least one center assembly to each of the first and second side assemblies.

4. An elevator cab, comprising:

a platform, side walls on said platform, a canopy having an opening therein, said canopy being supported by said side walls, a drop ceiling disposed below and spaced from said canopy, said drop ceiling including first and second side assemblies and at least one center assembly which extends between said first and second side assemblies, said first and second side assemblies and said at least one center assembly each including a metallic frame having a flat lower surface and a relatively large central opening, a decorative face plate having upper and lower major planar surfaces, means fixing the upper surface of said face plate to the lower surface of said metallic frame, and lighting means supported by each of the first and second side assemblies and the at least one central assembly, means suspending said first and second side assemblies from said canopy, said at least one center assembly including first and second portions which overlap said first and second side assemblies such that said first and second side assemblies provide the sole support for said at least one center assembly, and adjustment means on the overlapping portions of said at least one center assembly, accessible through the opening in said canopy, said adjustment means adjustably spacing the first and second overlapping portions of said at least one center assembly from the first and second side assemblies for planar alignment of a portion of said at least one center assembly with portions of said first and second side assemblies.

5. The elevator cab of claim 4 wherein the metallic frame includes an upstanding perimetrical flange which defines a rectangular outer periphery of the frame, with the lighting means including a fluorescent fixture disposed between the upstanding flange and the central opening on a side of the rectangular frame, and wherein the sides of the drop ceiling are spaced from the side walls to provide peripheral lighting.

6. The elevator cab of claim 5 wherein the upstanding flanges on the sides of the first and second side assemblies which adjoin the at least one center assembly are bent to provide horizontally oriented portions which support the first and second overlapping portions of the at least one center assembly, and the upstanding flanges on the sides of the at least one center assembly which adjoin the first and second side assemblies are bent to define the first and second overlapping portions.

7. The elevator cab of claim 4 wherein the lighting means associated with each of the first and second side assemblies and the at least one center assembly includes:

an elongated metallic member having a substantially hat-shaped cross-sectional configuration, including a U-shaped portion having a horizontally oriented bight portion, first and second spaced depending leg portions, and integral mounting flanges at the ends of the leg portions, said elongated metallic member being disposed in the central opening of the metallic frame with said mounting flanges being fixed to the upper surface of the decorative face plate, to define an elongated wiring trough and lamp fixture, at least one lamp in said elongated wiring trough and lamp fixture, and an opening in the decorative face plate below said at least one lamp.

8. The elevator cab of claim 7 including end cap members for closing the ends of the elongated wiring trough and lamp fixture, each of said end cap members including first and second leg portions, with said first leg portion being fixed to the associated metallic frame and with said second leg portion closing an end of the elongated wiring trough and lamp fixture.

9. The elevator cab of claim 7 wherein a selected one of the assemblies of the drop ceiling is electrified from an external power source, and including plugs and receptacles accessible through the opening in the canopy for distributing electrical power from the electrified assembly to the remaining assemblies of the drop ceiling.

10. An elevator cab, comprising:

a platform, side walls on said platform, a canopy having an opening therein, said canopy being supported by said side walls, a drop ceiling disposed below and spaced from said canopy, said drop ceiling including first and second side assemblies and at least one center assembly which extends between said first and second side assemblies, means suspending said first and second side assemblies from said canopy, said means suspending each of the first and second side assemblies from the canopy including a plurality of hanger strap assemblies each having a depending portion fixed to the canopy, an upstanding portion fixed to a side assembly, and coupling means for coupling said depending and upstanding portions, a pair of spaced slots in the canopy for each of said hanger strap assemblies, said depending portion of each hanger strap assembly having a bight disposed on the canopy and first and second depending leg portions disposed in the spaced slots, with one of said depending leg portions being coupled to an upstanding portion of a hanger strap assembly via said coupling means, said at least one center assembly including first and second portions which overlap said first and second side assemblies such that said first and second side assemblies provide the sole support for said at least one center assembly, and adjustment means on the overlapping portions of said at least one center assembly, accessible through the opening in said canopy, said adjustment means adjustably spacing the first and second overlapping portions of said at least one center assembly from the first and second side assemblies for planar alignment of a portion of said at least one center assembly with portions of said first and second side assemblies.

11. A method of constructing a drop ceiling comprising the steps of:

providing a platform, assembling an elevator cab having sidewalls and a canopy on said platform, providing an opening in said canopy, providing first and second side assemblies and at least one center assembly, each having a planar surface, providing upstanding first portions of hanger strap assemblies on the first and second side assemblies, suspending second portions of the hanger strap assemblies from the canopy, coupling the first and second portions of the hanger strap assemblies to suspend each of the first and second side assemblies from the canopy, supporting the at least one center assembly of the drop ceiling from the first and second side assemblies, providing adjustment means on the at least one center assembly, accessible through the opening in the canopy, and actuating the adjustment means to align the planar surface of the at least one center assembly with the planar surfaces of the first and second side assemblies, whereby the first and second side assemblies and the at least one center assembly cooperatively define a drop ceiling having co-planar surfaces which face the platform.

12. A method of constructing a drop ceiling in an elevator cab which includes a canopy having an opening therein, comprising the steps of:

constructing the drop ceiling in sections, including first and second side assemblies and at least one center assembly, providing upstanding first portions of hanger strap assemblies on the first and second side assemblies, suspending second portions of the hanger strap assemblies from the canopy, coupling the first and second portions of the hanger strap assemblies to suspend each of the first and second side assemblies from the canopy, supporting the at least one center assembly of the drop ceiling from the first and second side assemblies, providing adjustment means on the at least one center assembly, accessible through the opening in the canopy, actuating the adjustment means for planar alignment of a portion of the at least one center assembly with portions of the first and second side assemblies, providing fastener means actuatable through the opening in the canopy for fixing the at least one center assembly to the first and second side assemblies, and actuating the fastener means after the step of actuating the adjustment means.

13. A method of constructing a drop ceiling in an elevator cab which includes a canopy having an opening therein, comprising the steps of:

constructing the drop ceiling in sections, including first and second side assemblies and at least one center assembly, providing upstanding first portions of hanger strap assemblies on the first and second side assemblies, suspending second portions of the hanger strap assemblies from the canopy, coupling the first and second portions of the hanger strap assemblies to suspend each of the first and second side assemblies from the canopy, supporting the at least one center assembly of the drop ceiling from the first and second side assemblies, providing adjustment means on the at least one center assembly, accessible through the opening in the canopy, actuating the adjustment means for planar alignment of a portion of the at least one center assembly with portions of the first and second side assemblies, providing a pair of spaced slots in the canopy for each of the hanger strap assemblies, constructing the second portion of each hanger strap assembly in a substantially U-shaped configuration having a bight and first and second depending leg portions, and dropping the second portion of the hanger strap assembly into a pair of slots such that the first and second depending leg portions each enter a slot.

* * * * *